US008865988B2

(12) United States Patent
Nakata et al.

(10) Patent No.: US 8,865,988 B2
(45) Date of Patent: Oct. 21, 2014

(54) CYMBAL HOLDING STRUCTURE, CYMBAL STAND HAVING THE HOLDING STRUCTURE, AND FASTENER USED IN THE HOLDING STRUCTURE

(71) Applicant: Sakae Rhythm Musical Instrument Ltd., Osaka (JP)

(72) Inventors: Eizo Nakata, Osaka (JP); Shunsaku Tsuji, Tondabayashi (JP); Manabu Morioka, Nara (JP)

(73) Assignee: Sakae Rhythm Musical Instrument Ltd., Osaka-shi (JP)

( * ) Notice: Subject to any disclaimer, the term of this patent is extended or adjusted under 35 U.S.C. 154(b) by 0 days.

(21) Appl. No.: 14/050,858

(22) Filed: Oct. 10, 2013

(65) Prior Publication Data

US 2014/0096665 A1 Apr. 10, 2014

(30) Foreign Application Priority Data

Oct. 10, 2012 (JP) ..... 2012-224966

(51) Int. Cl.
*G10D 13/02* (2006.01)
*G10G 5/00* (2006.01)

(52) U.S. Cl.
CPC ..... *G10G 5/005* (2013.01)
USPC ..... 84/422.3

(58) Field of Classification Search
USPC ..... 84/422.1, 422.2, 422.3
See application file for complete search history.

(56) References Cited

U.S. PATENT DOCUMENTS 5,388,495 A * 2/1995 Atsumi ..... 84/422.3
6,011,209 A * 1/2000 Liao ..... 84/422.3

FOREIGN PATENT DOCUMENTS

| | | |
|---|---|---|
| JP | S57-8059 | 2/1982 |
| JP | S59-12190 | 1/1984 |
| JP | S62-30064 | 8/1987 |
| JP | H07-29593 | 6/1995 |

* cited by examiner

*Primary Examiner* — Kimberly Lockett
(74) *Attorney, Agent, or Firm* — Kratz, Quintos & Hanson, LLP

(57) ABSTRACT

Provided is a cymbal holding structure and a cymbal stand that make it possible to easily perform operations of adjustment of cymbal fastening force and attachment/detachment of a cymbal with one hand without using any tools, reliably prevent the loosening of a fastener, allow a performer to concentrate on his/her performance without anxiety, cause no burden on a cymbal supporting rod and a screw portion of the fastener, have long product life cycles, and maintain smooth operability for a long period of time.

11 Claims, 6 Drawing Sheets

(a)

(b)

CYMBAL HOLDING STRUCTURE, CYMBAL STAND HAVING THE HOLDING STRUCTURE, AND FASTENER USED IN THE HOLDING STRUCTURE

TECHNICAL FIELD

The present invention relates to a holding structure that holds a cymbal on a cymbal supporting rod, and particularly to a cymbal holding structure that has a fastener that does not get loosened during a performance, has excellent operability in adjustment of fastening force applied to a cymbal and attachment/detachment of the cymbal, and can be suitably used in a high-hat stand and a cymbal stand having the cymbal holding structure.

BACKGROUND ART

In various cymbal stands such as a high-hat stand in which two upper and lower cymbals are brought to butt against each other by a stepping-on operation of a pedal and a cymbal stand in which each cymbal is independently arranged thereon to play the cymbal, there has been conventionally employed a holding structure for holding a cymbal on a cymbal supporting rod in which a fastener having a screw hole is screwed with a bolt portion of the cymbal supporting rod, and the cymbal is fastened through a felt washer or the like (for example, refer to Patent Documents 1 to 3).

Since cymbals in these stands largely vibrate due to striking impact received during a performance, a fastener easily gets loosened. Especially in a high-hat stand, large vibration is generated due to butting between upper and lower cymbals. Therefore, in order to prevent a fastener from getting loosened, a double nut structure is employed in an upper cymbal holding structure for holding the cymbal. Further, since even such a double nut structure is not sufficient to prevent the loosening of a fastener, there has also been proposed a structure that includes a cutout groove which communicates with a screw hole to be screwed with a bolt portion of a cymbal supporting rod, and a pair of screw mounting units which are opposed to each other across the cutout groove. In this structure, these screw mounting units are connected to each other by a fastening screw to narrow a distance between the mounting units so that the screw hole is pressed against the bolt portion (refer to Patent Document 4).

However, not only in the double nut structure described above, but also in the structure described in Patent Document 4, a tool for fastening a fastening screw with a large torque and force for the fastening are required, and the fastening is a complicated operation using both hands. For example, in a cymbal holding structure for an upper cymbal in a high-hat stand, the cymbal is held using upper and lower bolts so as to be sandwiched between the bolts. The upper bolt serves as a screw for adjusting the cymbal fastening force, and the lower bolt serves as a screw for supporting the cymbal as well as used in detachment of the cymbal. However, these operations of adjustment of the cymbal fastening force and attachment/detachment of the cymbal are made to be complicated.

Further, since a cymbal is fastened by frictional pressure-contact force of a screw in all of these structures, it is not possible to reliably prevent the loosening of a fastener. Therefore, a performer cannot always play the cymbal without anxiety. In addition, a large torque is required for the fastening in order to prevent the loosening of a fastener. Therefore, a screw portion may be deformed while repeatedly using the structure, and the attachment operation may not be smoothly performed over time.

CITATION LIST

Patent Literatures

Patent Document 1: JP-UM-B No. S57-8059
Patent Document 2: JP-UM-A No. S59-12190
Patent Document 3: JP-UM-B No. S62-30064
Patent Document 4: JP-UM-A No. H07-29593

SUMMARY OF INVENTION

Technical Problem

Therefore, in view of the aforementioned situation, the present invention is directed to provide a cymbal holding structure and a cymbal stand that make it possible to easily perform operations of adjustment of cymbal fastening force and attachment/detachment of a cymbal with one hand without using any tools, reliably prevent the loosening of a fastener, allow a performer to concentrate on his/her performance without anxiety, cause no burden on a cymbal supporting rod and a screw portion of the fastener, have long product life cycles, and maintain smooth operability for a long period of time.

Solution to Problem

In order to solve the aforementioned problems, the present invention has achieved a cymbal holding structure that comprises a cymbal supporting rod to be inserted into a center hole of a cymbal, the cymbal supporting rod including a bolt portion, and at least one elongated groove formed on the bolt portion, the at least one elongated groove extending across a spiral groove; and at least one fastener including a screw hole, a groove portion communicating with the screw hole, a locking claw slidingly guided in a radial direction along an inner surface of the groove portion so as to be protruded into and retracted from the screw hole, a biasing unit elastically biasing the locking claw so as to be protruded into the screw hole, and an operation unit operating the locking claw so as to be retracted from the screw hole against elastic biasing force of the biasing unit, wherein the at least one fastener is screwed with the bolt portion of the cymbal supporting rod to fasten the cymbal so as to be held on the cymbal supporting rod, and wherein the at least one fastener is brought into a loosening-prevented state in which the at least one fastener cannot rotate at least in a loosening direction by engagingly inserting the locking claw into the at least one elongated groove of the bolt portion, and the loosening-prevented state is released by operating the operation unit to retract the locking claw from the screw hole.

It is preferred that the operation unit comprise an operation member having a curved shape in plan view, the operation member including the locking claw integrally formed with an end thereof and continuously extending from the locking claw around the screw hole.

In particular, it is preferred that the operation member be formed to extend up to a position opposite to the locking claw with respect to an axial center or the vicinity thereof.

Further, it is preferred that the at least one fastener further include a cutout groove which is opened on an outer peripheral wall at a midway part in an axial direction thereof and communicates with the screw hole, and the operation member having the locking claw be slidably placed inside the cutout groove.

More specifically, it is preferred that the at least one fastener further include a pin which extends in the axial direction and is provided in a standing manner inside the cutout groove, and an operation member elongated groove formed on the operation member through which the pin passes and which also extends in parallel to a sliding direction of the locking claw, and a spring be housed, as the biasing unit, in the operation member elongated groove at a space on the opposite side of the locking claw with respect to the pin inside the operation member elongated groove, and the operation member be elastically biased by the spring so that the locking claw is protruded into the screw hole.

Further, it is preferred that the cymbal supporting rod be a hollow bolt to be attached to an up/down rod of a high-hat stand, the at least one elongated groove comprises two elongated grooves which are formed over respective two areas along the axial direction of the bolt portion, the at least one fastener comprises two fasteners which are positioned at the respective two areas in a loosening-prevented state in which locking claws of the fasteners are engagingly inserted into the elongated grooves, and the cymbal be held between the fasteners.

Further, the present invention also provides a cymbal stand including the cymbal holding structure described above.

In particular, it is preferred that the cymbal stand be a high-hat stand in which the cymbal supporting rod is a hollow bolt to be attached to an up/down rod of the high-hat stand.

Further, the present invention also provides a fastener used in the cymbal holding structure described above, the fastener comprising the screw hole, the groove portion, the locking claw, the biasing unit, and the operation unit.

Advantageous Effects of Invention

According to the cymbal holding structure of the present invention described above, the fastener is brought into a loosening-prevented state when the locking claw which is elastically biased so as to be protruded into the screw hole is engagingly inserted into the elongated groove of the bolt portion, and the loosening-prevented state is released by operating the operation unit to retract the locking claw from the screw hole. Therefore, operations of adjustment of the fastening force applied to the cymbal and attachment/detachment of the cymbal can be easily performed with one hand without using any tools only by operating the operation unit to rotate the fastener. Further, the loosening-prevented state is achieved by the engagement between the locking claw and the elongated hole. Therefore, fastening force for preventing the loosening is not required, no burden is caused on the cymbal supporting rod and the screw portion of the fastener, long product life cycles can be ensured, and smooth operability can be maintained for a long period of time. In addition, the loosening-prevented state is reliably and stably achieved by the engagement between the locking claw and the elongated hole, and a performer can therefore concentrate on his/her performance.

Further, the operation unit comprises an operation member having a curved shape in plan view, the operation member including the locking claw integrally formed with an end thereof and continuously extending from the locking claw around the screw hole. Therefore, the structure is made simple, the number of components can be reduced, and the durability can be made excellent.

Further, the operation member is formed to extend up to a position opposite to the locking claw with respect to an axial center or the vicinity thereof. Therefore, it is possible to efficiently operate the locking claw with minimum force passing through the axial center.

Further, the fastener includes a cutout groove which is opened on an outer peripheral wall at a midway part in an axial direction thereof and communicates with the screw hole. Furthermore, the operation member having the locking claw is slidably placed inside the cutout groove. Therefore, it is possible to achieve a smooth movement of the locking claw with a simple structure.

Further, the fastener includes a pin which extends in the axial direction and is provided in a standing manner inside the cutout groove, and an operation member elongated groove formed on the operation member through which the pin passes and which also extends in parallel to a sliding direction of the locking claw. Furthermore, a spring is housed, as the biasing unit, in the operation member elongated groove at a space on the opposite side of the locking claw with respect to the pin inside the operation member elongated groove. Moreover, the operation member is elastically biased by the spring so that the locking claw is protruded into the screw hole. Therefore, it is possible to achieve a structure for efficiently biasing the locking claw by the spring so as to be protruded in to the screw hole.

Further, the cymbal supporting rod is a hollow bolt to be attached to an up/down rod of a high-hat stand, the elongated grooves are formed over respective two areas along the axial direction of the bolt portion, the fasteners are positioned at the respective two areas in a loosening-prevented state in which locking claws of the fasteners are engagingly inserted into the elongated grooves, and the cymbal is held between the fasteners. Therefore, these fasteners can stably hold an upper cymbal in a high-hat stand which causes especially large vibration. In addition, the operation of adjustment of the fastening force applied to the cymbal by the upper fastener and the operation of attachment/detachment of the cymbal by the lower fastener can be easily performed with one hand without using any tools as described above. As a result, it is possible to provide an excellent high-hat stand capable of maintaining smooth operability for a long period of time.

BRIEF DESCRIPTION OF DRAWINGS

FIG. 5(*b*) is a cross-sectional view of the principal part of the cymbal holding structure in a state where the fastener is in a released state.

DESCRIPTION OF EMBODIMENTS

Next, an embodiment of the present invention will be described in detail with reference to the attached drawings. In the following embodiment, an example in which the cymbal holding structure of the present invention is applied to a holding structure for an upper cymbal in a high-hat stand will be described. However, the present invention is not limited to such a high-hat stand, and can also be applied to various cymbal stands such as a cymbal stand for holding a single cymbal or a cymbal holding structure such as an attachment.

Figure 1:
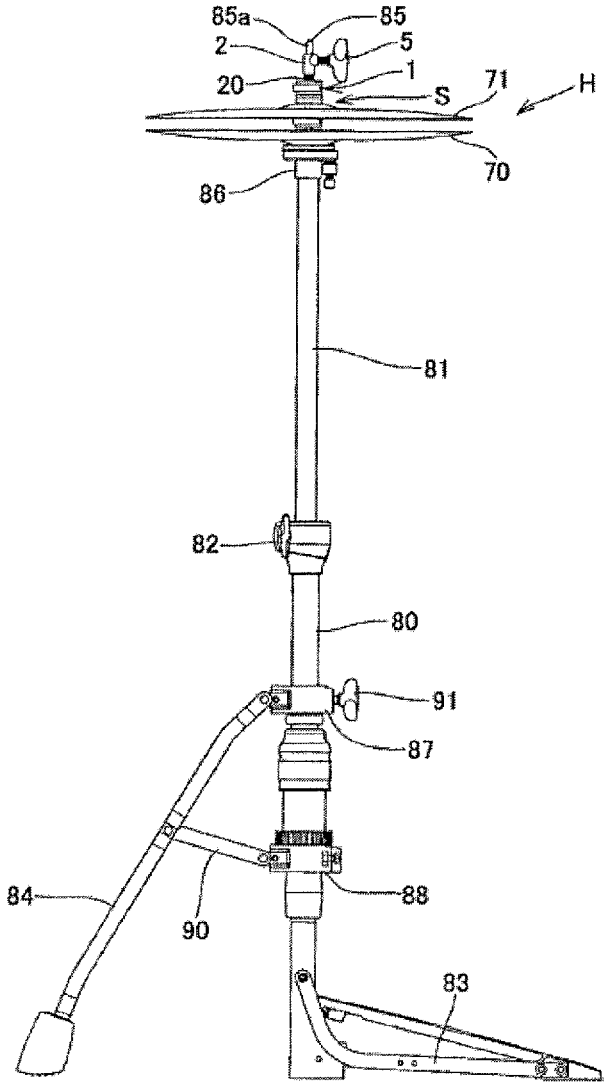
FIG. 1 is a diagram of the overall configuration of a high-hat stand having a cymbal holding structure of the present invention.

As shown in FIG. 1, a high-hat stand H as an embodiment which has a cymbal holding structure S according to the present invention is provided with two foldable legs 84, a pedal 83, a lower pipe 80 which is provided in a standing manner by the legs 84 and the pedal 83, an upper pipe 81 which is inserted into the upper part of the lower pipe 80 and supported by a thumbscrew 82 in a height-adjustable manner, an up/down rod 85 which is inserted into the upper pipe 81 and the lower pipe 80 so as to protrude from the bottom of the lower pipe 80 and connected to the pedal 83, and moved up and down by a stepping-on operation of the pedal 83, and a coil spring (not shown) which is stored inside the lower pipe 80 and biases the up/down rod 85 upward. Although the high-hat stand H is mainly made of a metallic material in the present embodiment, the present invention is not particularly limited thereto.

A cymbal receiver 86 is attached to the upper end part of the upper pipe 81. A lower cymbal 70 is supported on the cymbal receiver 86. A cymbal holder 1 is attached to an upper end part 85*a* of the up/down rod 85 which protrudes from the upper end of the upper pipe 81. An upper cymbal 71 is held by the cymbal holder 1 in a position adjustable manner. By stepping on the pedal 83, the up/down rod 85 is pulled down against the coil spring. The upper cymbal 71 is also moved downward integrally with the up/down rod 85, and strikes the lower cymbal 70 supported on the cymbal receiver 86.

A first support metal fitting 87 is attached to the outer peripheral wall of the lower pipe 80 at the midway part in the axial direction thereof by the fastening by the thumbscrew 91 so as to be slidable up and down. The upper ends of the legs 84 are connected to the support metal fitting 87 so as to be turnable up and down. A second support metal fitting 88 is attached to the outer peripheral wall of the lower pipe 80 at the lower part thereof. Each of stays 90 has one end which is connected to the middle part of each of the legs 84 so as to be turnable up and down and the other end which is connected to the support metal fitting 88 so as to be turnable up and down. When the thumbscrew 91 attached to the first support metal fitting 87 is loosened to thereby cause the first support metal fitting 87 to slide upward, the upper ends of the legs 84 and both of the ends of the stays 90 turn, so that each of the legs 84 changes its posture into a storage posture along the lower pipe 80.

Figure 2:
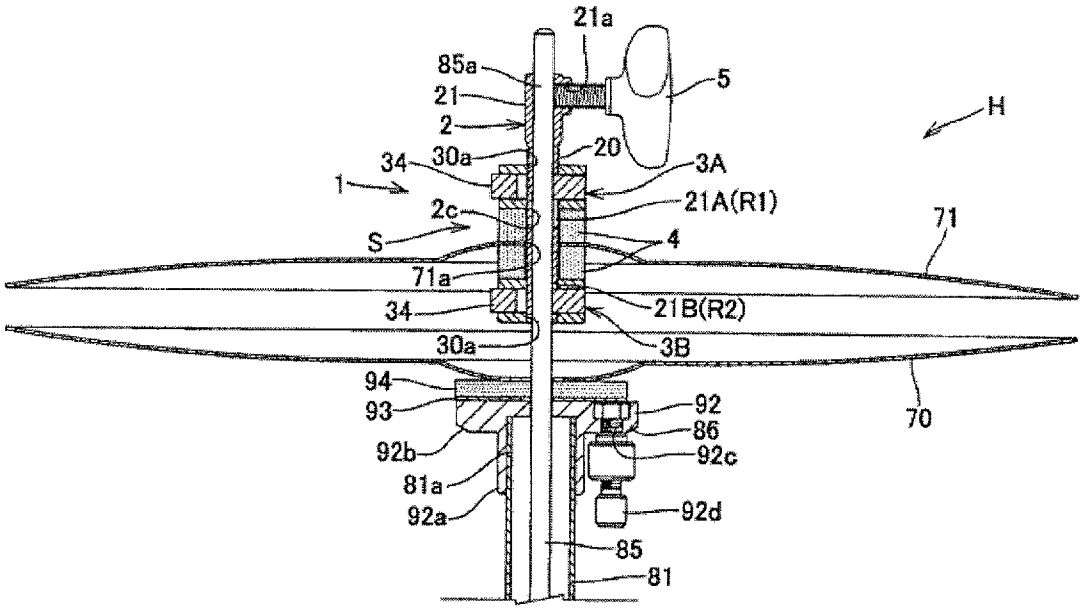
FIG. 2 is a cross-sectional view illustrating a cymbal holding structure that holds an upper cymbal in the high-hat stand.

As shown in a cross-sectional view of FIG. 2, the cymbal receiver 86 which supports the lower cymbal 70 includes a tray member 92 which is fitted with the outer peripheral surface of an upper end part 81*a* of the upper pipe 81 and has a hole through which the up/down rod 85 is inserted on the center thereof, and a plate 93 and a felt 94 which are stacked on the top surface of the tray member 92 and also have holes through which the up/down rod 85 is inserted on the centers thereof. The tray member 92 includes a cylindrical portion 92*a* which is fitted with the upper end part 81*a* of the upper pipe 81 and a flange-shaped cymbal supporting portion 92*b* which is formed on the top of the cylindrical portion 92*a*. The cymbal supporting portion 92*b* has a screw hole 92*c* near the outer periphery thereof, and a bolt 92*d* for adjusting the angle of the lower cymbal 70 is screwed with the screw hole 92*c*.

Figure 3:
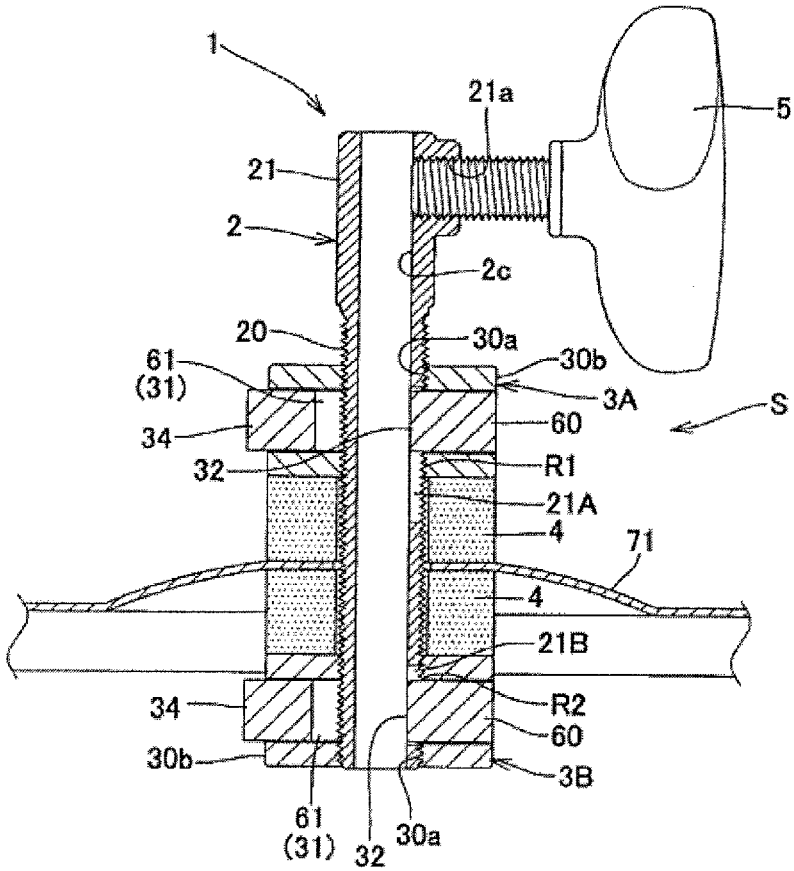
FIG. 3 is a cross-sectional view illustrating a cymbal holder that constitutes the cymbal holding structure.

The cymbal holder 1 constitutes the cymbal holding structure S according to the present invention as a main component. As shown in FIG. 2 and FIG. 3, the cymbal holder 1 includes a hollow bolt 2 as a cymbal supporting rod which is inserted through a center hole 71*a* of the upper cymbal 71 and has a center hole 2*c* through which the up/down rod 85 is inserted so that the hollow bolt 2 is attached to the upper end part of the up/down rod 85, a pair of upper and lower felt washers 4 which are externally attached to the hollow bolt 2 and hold the upper cymbal 71 therebetween, fasteners 3A and 3B which are respectively positioned on the top of the upper felt washer 4 and under the bottom of the lower felt washer 4 and screwed with the hollow bolt 2, and a thumbscrew 5 which fixes the hollow bolt 2 to the up/down rod 85.

The hollow bolt 2 includes a bolt portion 20, the outer peripheral surface of which is threaded to form a male screw, and a cylindrical portion 21 which is integrally formed with the upper end of the bolt portion 20. A screw hole 21*a* which communicates with the center hole 2*c* is formed on the outer peripheral surface of the cylindrical portion 21. By screwing the thumbscrew 5 with the screw hole 21*a*, the up/down rod 85 is pressed against the inner surface of the center hole 2*c* of the cylindrical portion 21, and the hollow bolt 2 is thereby fixed to the up/down rod 85. Although the cylindrical portion 21 is integrally formed with the hollow bolt 2 in the present embodiment, another configuration in which a separately prepared cylindrical member is attached to the upper end of a hollow bolt with a screw or the like is also preferred.

Figure 4:
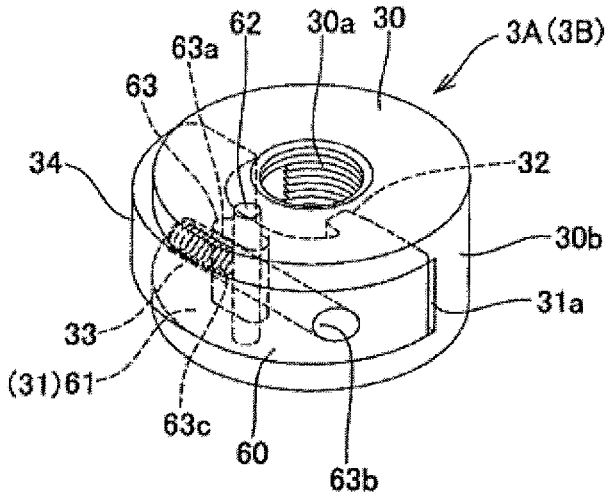
FIG. 4 is a perspective view illustrating a fastener used in the cymbal holding structure.
Figure 5:
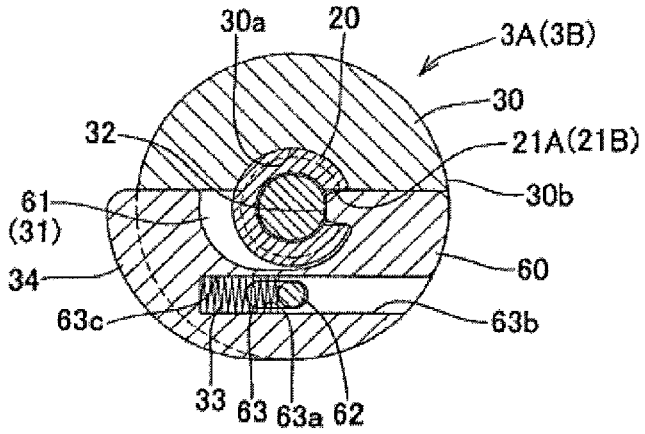
FIG. 5(*a*) is a cross-sectional view of a principal part of the cymbal holding structure in a state where the fastener is in a loosening-prevented state.
Figure 5:
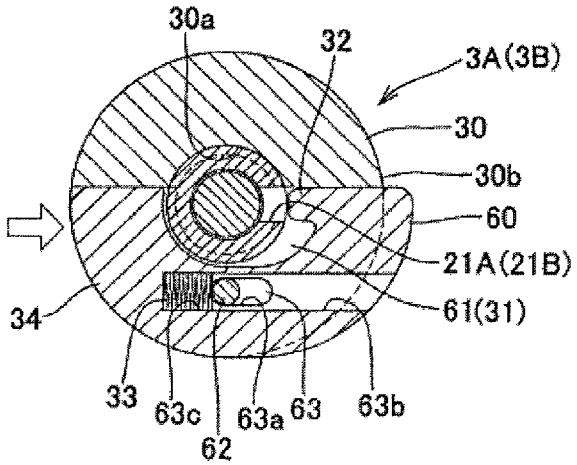
Figure 6:
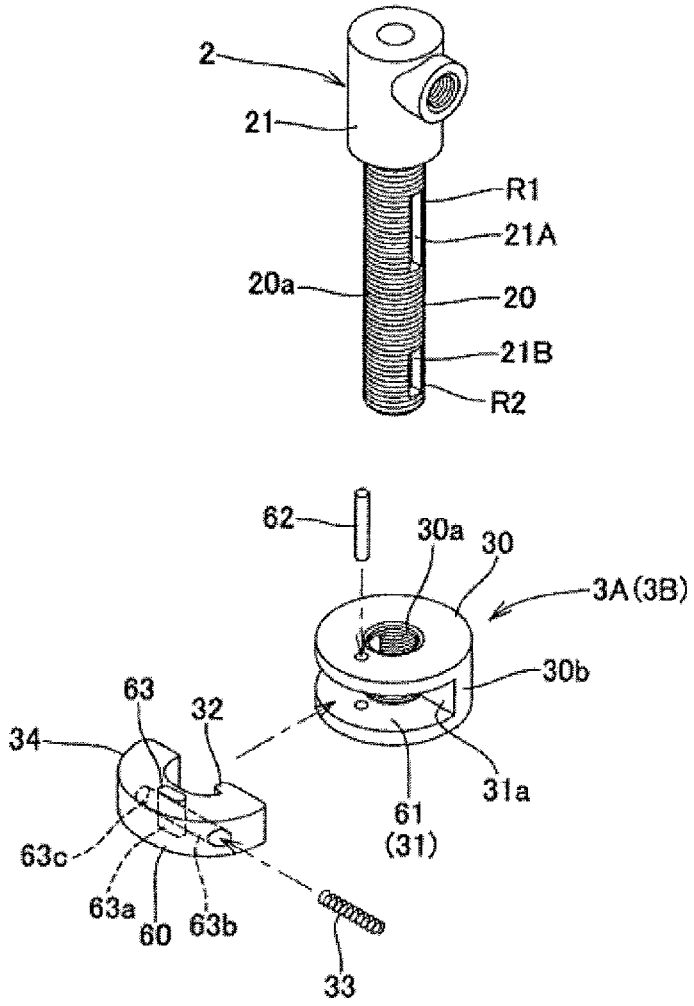
FIG. 6 is an exploded perspective view of a hollow bolt and the fastener used in the cymbal holding structure.

As shown in FIGS. 4 to 6, each of the fasteners 3A and 3B includes a main body 30 which has a screw hole 30*a* to be screwed with the bolt portion 20 of the hollow bolt 2 on the center thereof and a groove portion 31 which is opened on an outer peripheral wall 30*b* and communicates with the screw hole 30*a*, a locking claw 32 which is slidingly guided in the radial direction along an inner surface 31*a* of the groove portion 31 so as to be protruded into and retracted from the screw hole 30*a*, a spring 33 as biasing unit which elastically biases the locking claw 32 so as to be protruded into the screw hole 30*a*, and an operation unit 34 which operates the locking claw 32 so as to be retracted from the screw hole 30*a* against the elastic biasing force of the biasing unit (the spring 33).

In the present embodiment, the locking claw 32 and the operation unit 34 are integrally formed with each other as operation member 60. Specifically, the locking claw 32 is integrally formed with one end of the operation member 60. The operation member 60 having a curved shape in plan view continuously extends from the locking claw 32 so as to form a generally C-shape around the screw hole 30*a*, thereby forming the operation unit 34. As the groove portion 31, a cutout groove 61 which is opened on the outer peripheral wall 30*b* at the midway part in the axial direction thereof and communicates with the screw hole 30*a* is formed within the range of approximately 180° around the axial center of the main body 30. The operation member 60 is slidably placed inside the cutout groove 61. The inner surface 31*a* of the groove portion 31 is formed on the cutout groove 61 at a region corresponding to the position of the locking claw 32.

In the present embodiment, since the operation member 60 is formed to extend up to a position that is opposite to the locking claw 32 with respect to the axial center of the main body 30 or the vicinity thereof, the cutout groove 61 is also formed within the range of approximately 180° so as to correspond to the shape of the operation member 60. However, the operation member 60 may extend around the screw hole 30*a* in a shorter distance so as to be formed into an approximately J-shape, and the cutout groove 61 may also be formed within a narrower angle range so as to correspond to the shape of the operation member 60.

A pin 62 which extends in the axial direction is provided in a standing manner inside the cutout groove 61. An elongated groove 63 through which the pin 62 passes and which also extends in parallel to the sliding direction of the locking claw 32 is formed on the operation member 60. The spring 33 is housed, as biasing unit, inside the elongated groove 63 at a space on the opposite side of the locking claw 32 with respect to the pin 62 inside the elongated groove 63. Although the spring 33 is a coil spring in the present embodiment, other types of springs may also be used. Further, an elastic member such as rubber can also be used as the spring 33. In the operation member 60, the locking claw 32 is elastically biased by the spring 33 so as to be protruded into the screw hole 30*a*.

More specifically, the elongated groove 63 includes an elongated hole 63*a* which penetrates the operation member 60 in the axial direction and receives the pin 62, and a horizontal hole 63*b* which intersects the elongated hole 63*a* and extends in parallel to the sliding direction of the locking claw 32. A bottomed concave portion 63*c* which communicates with the elongated hole 63*a* and houses the spring 33 therein is formed in the horizontal hole 63*b*. Assembly in manufacturing these components can be easily performed by first inserting the spring 33 from an opening of the horizontal hole 63*b* on the opposite side of the concave portion 63*c*, and then inserting the pin 62 through the elongated hole 63*a*.

As shown in FIG. 3 and FIG. 6, the bolt portion 20 of the hollow bolt 2 has elongated grooves 21A and 21B each of which extends across a spiral groove 20*a*. The elongated grooves 21A and 21B are respectively formed over two areas R1 and R2 which extend along the axial direction. The fasteners 3A and 3B which are screwed with the bolt portion 20 are respectively positioned at the areas R1 and R2. As a result, it is possible to achieve an unrotatable loosening-prevented state in which the locking claws 32 of the fastener 3A and 3B are engagingly inserted into the elongated grooves 21A and 21B, respectively. The upper cymbal 71 is stably held between the fasteners 3A and 3B in the loosening-prevented state with the felt washers 4 interposed therebetween.

Also in the respective areas R1 and R2, the fasteners 3A and 3B can be rotated to move to any positions by pushing the operation units 34 to thereby retract the locking claws 32. While the fastener 3A (3B) is caused to make a single rotation from the moved position with the operation unit 34 released, the locking claw 32 is engagingly inserted into the elongated groove 21A (21B). As a result, the fastener 3A (3B) can be brought into the unrotatable loosening-prevented state. In the present embodiment, when the locking claw 32 is engagingly inserted into the elongated groove 21A (21B), the fastener 3A (3B) cannot rotate in both of the loosening direction and the fastening direction unless the operation unit 34 is operated. However, for example, it is also preferred that only a side surface of the locking claw 32, the side surface being positioned in the fastening direction, be formed into a tapered surface. In such a configuration, the fastener 3A (3B) with the locking claw 32 engagingly inserted into the elongated groove 21A (21B) cannot rotate in the loosening direction without operating the operation unit 34. However, the fastener 3A (3B) can rotate in the fastening direction because the tapered surface is pushed by the edge of the elongated groove 21A (21B), and the locking claw 32 thereby automatically retracts from the screw hole 30*a*. In this case, the operation unit should be operated only when rotating the fastener 3A (3B) in the loosening direction. Therefore, the operability is improved.

Each of the elongated grooves 21A and 21B is a vertical groove which extends in the axial direction in the present embodiment. However, each of the elongated grooves 21A and 21B may be oblique groove or curved groove. Further, each of the elongated grooves 21A and 21B is formed around the bolt portion 20 at a single location, and the locking claw 32 is engagingly inserted thereinto only once by every single rotation of the fastener 3A (3B) in the present embodiment. However, it is also preferred that a plurality of elongated grooves 21A (21B) be formed so that the locking claw 32 can be engagingly inserted thereinto multiple times by every single rotation of the fastener 3A (3B), thereby making it possible to perform finer position adjustment and fastening force adjustment for the upper cymbal 71. In this case, the elongated grooves 21A (21B) may be formed throughout the area R1 (R2). Alternatively, excepting a first one of the elongated grooves 21A (21B), elongated grooves having a relatively short length may be supplementarily formed only within a particular area in the area R1 (R2) in which fine adjustment is desirably performed.

In the cymbal holding structure S in the present embodiment, each of the fasteners 3A and 3B which fasten the upper cymbal 71 from top and bottom is provided with the screw hole 30*a*, the groove portion 31, the locking claw 32, the spring 33 as biasing unit, and the operation unit 34. However, only one of the fasteners 3A and 3B may have the above configuration, and the other one may be a conventional fastener such as a double nut. For example, even when the fastener of the present embodiment is applied only to the lower fastener 3B, it is possible to easily detach the upper cymbal only with hands after a performance, and also easily and reliably attach the upper cymbal with one hand in a loosening-prevented state. Therefore, such a configuration is also preferred.

Further, also when the fastener of the present embodiment is applied only to the upper fastener 3A, the upper fastener 3A which is used to adjust the fastening force applied to a cymbal by a performer can be easily rotated only with hands without using any tools to thereby adjust the fastening force and bring the fastener 3A into a loosening-prevented state. Therefore, such a configuration is also preferred. Similarly, although a description has been made with regard to the holding structure for an upper cymbal in a high-hat stand in the present embodiment, the present invention can also be applied to other cymbal stands and cymbal attachments as described above. When using only one fastener for fastening a cymbal having a screw hole in these cymbal stands and cymbal attachments, by using the fastener 3A of the present embodiment, it is possible to easily rotate the fastener 3A only with hands without using any tools to thereby adjust the fastening force applied to the cymbal and bring the fastener 3A into a loosening-prevented state in the same manner as above.

While the embodiment of the present invention has been described, the present invention is not limited to the described embodiment. It should therefore be understood that the present invention can be embodied in various forms without departing from the scope of the invention.

REFERENCE SIGNS LIST

H High-hat stand
S Cymbal holding structure
R1 and R2 Area
1 Cymbal holder
2 Hollow bolt
2*c* Center hole
3A and 3B Fastener
4 Felt washer
5 Thumbscrew

20 Bolt portion
20*a* Spiral groove
21 Cylindrical portion
21*a* Screw hole
21A and 21B Elongated groove
30 Main body
30*a* Screw hole
30*b* Outer peripheral wall
31 Groove portion
31*a* Inner surface
32 Locking claw
33 Spring
34 Operation unit
60 Operation member
61 Cutout groove
62 Pin
63 Elongated groove
63*a* Elongated hole
63*b* Horizontal hole
63*c* Concave portion
70 Lower cymbal
71 Upper cymbal
71*a* Center hole
80 Lower pipe
81 Upper pipe
81*a* Upper end part
82 Thumbscrew
83 Pedal
84 Leg
85 Up/down rod
85*a* Upper end part
86 Cymbal receiver
87 Support metal fitting
88 Support metal fitting
90 Stay
91 Thumbscrew
92 Tray member
92*a* Cylindrical portion
92*b* Cymbal supporting portion
92*c* Screw hole
92*d* Angle adjusting bolt
93 Plate
94 Felt

The invention claimed is:

1. A cymbal holding structure comprising:

a cymbal supporting rod to be inserted into a center hole of a cymbal, the cymbal supporting rod including a bolt portion, and at least one elongated groove formed on the bolt portion, the at least one elongated groove extending across a spiral groove; and at least one fastener including a screw hole, a groove portion communicating with the screw hole, a locking claw slidingly guided in a radial direction along an inner surface of the groove portion so as to be protruded into and retracted from the screw hole, a biasing unit elastically biasing the locking claw so as to be protruded into the screw hole, and an operation unit operating the locking claw so as to be retracted from the screw hole against elastic biasing force of the biasing unit, wherein the at least one fastener is screwed with the bolt portion of the cymbal supporting rod to fasten the cymbal so as to be held on the cymbal supporting rod, and wherein the at least one fastener is brought into a loosening-prevented state in which the at least one fastener cannot rotate at least in a loosening direction by engagingly inserting the locking claw into the at least one elongated groove of the bolt portion, and the loosening-prevented state is released by operating the operation unit to retract the locking claw from the screw hole.

2. The cymbal holding structure according to claim 1, wherein the operation unit comprises an operation member having a curved shape in plan view, the operation member including the locking claw integrally formed with an end thereof and continuously extending from the locking claw around the screw hole.

3. The cymbal holding structure according to claim 2, wherein the operation member is formed to extend up to a position opposite to the locking claw with respect to an axial center or the vicinity thereof.

4. The cymbal holding structure according to claim 2, wherein the at least one fastener further includes a cutout groove which is opened on an outer peripheral wall at a midway part in an axial direction thereof and communicates with the screw hole, and the operation member having the locking claw is slidably placed inside the cutout groove.

5. The cymbal holding structure according to claim 4, wherein the at least one fastener further includes a pin which extends in the axial direction and is provided in a standing manner inside the cutout groove, and an operation member elongated groove formed on the operation member through which the pin passes and which also extends in parallel to a sliding direction of the locking claw, and wherein a spring is housed, as the biasing unit, in the operation member elongated groove at a space on the opposite side of the locking claw with respect to the pin inside the operation member elongated groove, and the operation member is elastically biased by the spring so that the locking claw is protruded into the screw hole.

6. The cymbal holding structure according to claim 1, wherein the cymbal supporting rod is a hollow bolt to be attached to an up/down rod of a high-hat stand, the at least one elongated groove comprises two elongated grooves which are formed over respective two areas along the axial direction of the bolt portion, the at least one fastener comprises two fasteners which are positioned at the respective two areas in a loosening-prevented state in which locking claws of the fasteners are engagingly inserted into the elongated grooves, and the cymbal is held between the fasteners.

7. A cymbal stand including the cymbal holding structure according to claim 1.

8. The cymbal stand according to claim 7, wherein the cymbal stand is a high-hat stand in which the cymbal supporting rod is a hollow bolt to be attached to an up/down rod of the high-hat stand.

9. A fastener used in the cymbal holding structure according to claim 1, the fastener comprising the screw hole, the groove portion, the locking claw, the biasing unit, and the operation unit.

10. The cymbal holding structure according to claim 3, wherein the at least one fastener further includes a cutout groove which is opened on an outer peripheral wall at a midway part in an axial direction thereof and communicates with the screw hole, and the operation member having the locking claw is slidably placed inside the cutout groove.

11. The cymbal holding structure according to claim 10, wherein the at least one fastener further includes a pin which extends in the axial direction and is provided in a standing manner inside the cutout groove, and an operation member elongated groove formed on the operation member through which the pin passes and which also extends in parallel to a sliding direction of the locking claw, and wherein a spring is housed, as the biasing unit, in the operation member elongated groove at a space on the opposite side of the locking claw with respect to the pin inside the operation member elongated groove, and the operation member is elastically biased by the spring so that the locking claw is protruded into the screw hole.

* * * * *